US009528052B2

(12) United States Patent
Smegal et al.

(10) Patent No.: US 9,528,052 B2
(45) Date of Patent: Dec. 27, 2016

(54) TWO STAGE DIESEL AROMATICS SATURATION PROCESS USING BASE METAL CATALYST

(71) Applicant: SHELL OIL COMPANY, Houston, TX (US)

(72) Inventors: John Anthony Smegal, Houston, TX (US); Aristides Macris, The Woodlands, TX (US)

(73) Assignee: SHELL OIL COMPANY, Houston, TX (US)

( * ) Notice: Subject to any disclaimer, the term of this patent is extended or adjusted under 35 U.S.C. 154(b) by 160 days.

(21) Appl. No.: 14/281,425

(22) Filed: May 19, 2014

(65) Prior Publication Data

US 2014/0339133 A1 Nov. 20, 2014

Related U.S. Application Data

(60) Provisional application No. 61/825,313, filed on May 20, 2013, provisional application No. 61/828,743, filed on May 30, 2013.

(51) Int. Cl.
*C10G 65/08* (2006.01)
*C10G 45/50* (2006.01)
(Continued)

(52) U.S. Cl.
CPC ..... *C10G 65/08* (2013.01); *C10G 45/50* (2013.01)

(58) Field of Classification Search
CPC ..... C10G 65/00; C10G 65/02; C10G 65/04; C10G 65/08; C10G 45/44; C10G 45/46; C10G 45/48; C10G 45/50
See application file for complete search history.

(56) References Cited

U.S. PATENT DOCUMENTS 3,236,764 A 2/1966 Den Herder et al.
5,110,444 A 5/1992 Haun et al.
(Continued)

FOREIGN PATENT DOCUMENTS

EP 321713 6/1989
EP 1319701 6/2003
WO 2009085696 6/2009

OTHER PUBLICATIONS

Toulhoat, H. et al. (2013), Catalysis by Transition Metal Sulphides from Molecular Theory to Industrial Application, Editions Technip, 787 pgs (Office action cites pp. 711-712).*

*Primary Examiner* — Brian McCaig

(57) ABSTRACT

A process that provides for the improvement of the properties of a distillate feedstock that has significant concentrations of nitrogen and polyaromatic compounds. The process includes a first reaction zone that uses a base metal catalyst and is operated under high pressure conditions to provide for the hydrodenitrogenation of organic nitrogen and saturation of polyaromatic compounds contained in the distillate feedstock. The first reaction zone treated effluent is separated into a heavy fraction and a lighter fraction with the heavy fraction being charged to a second reaction zone that also uses a base metal catalyst and is operated under high pressure conditions to provide for the saturation of monaromatic compounds that are contained in the heavy fraction. The inventive process provides for a high quality, low-sulfur and low-nitrogen diesel product that has a significantly lower aromatics content than the distillate feedstock and having a high value for its high Cetane Index.

5 Claims, 1 Drawing Sheet

(51) Int. Cl.

| | |
|---|---|
| *C10G 65/00* | (2006.01) |
| *C10G 65/02* | (2006.01) |
| *C10G 65/04* | (2006.01) |
| *C10G 45/44* | (2006.01) |
| *C10G 45/46* | (2006.01) |
| *C10G 45/48* | (2006.01) |

(56) References Cited

U.S. PATENT DOCUMENTS

| | | | | |
|---|---|---|---|---|
| 5,114,562 | A | 5/1992 | Haun et al. | |
| 6,218,333 | B1 | 4/2001 | Gabrielov et al. | |
| 6,281,158 | B1 | 8/2001 | Gabrielov et al. | |
| 6,290,841 | B1 | 9/2001 | Gabrielov et al. | |
| 6,676,829 | B1 * | 1/2004 | Angevine | C10G 45/52 208/210 |
| 7,381,321 | B2 | 6/2008 | Benazzi et al. | |
| 7,790,020 | B2 | 9/2010 | Kokayeff et al. | |
| 8,262,905 | B2 | 9/2012 | Gabrielov et al. | |
| 2005/0167334 | A1 | 8/2005 | Galeazzi | |
| 2009/0095656 | A1 | 4/2009 | Kokayeff et al. | |
| 2010/0018905 | A1 * | 1/2010 | Ho | C10G 45/72 208/214 |

* cited by examiner

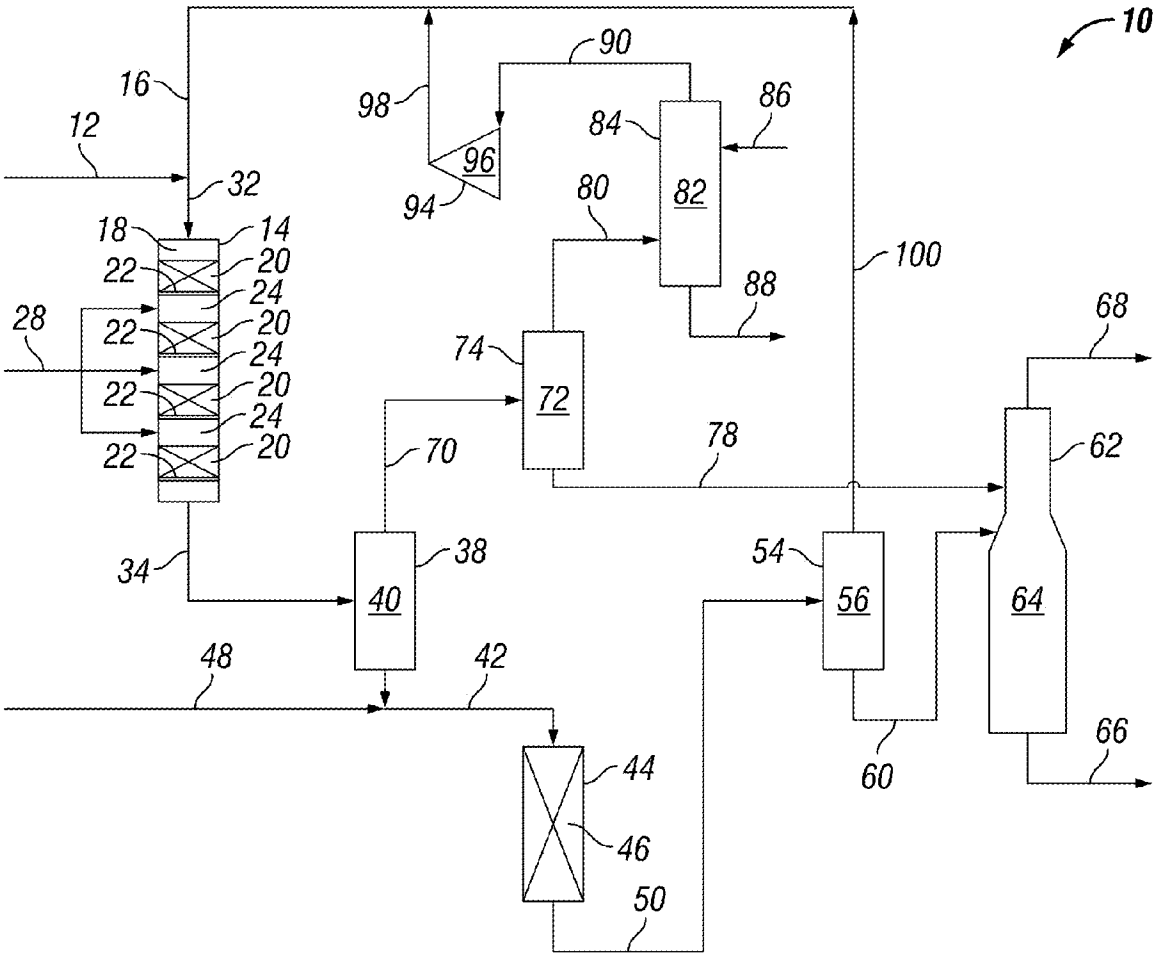
10
12
14
16
18
20
22
24
28
32
34
38
40
42
44
46
48
50
54
56
60
62
64
66
68
70
72
74
78
80
82
84
86
88
90
94
96
98
100

TWO STAGE DIESEL AROMATICS SATURATION PROCESS USING BASE METAL CATALYST

The present non-provisional application claims the benefit of pending U.S. Provisional Patent Application Ser. No. 61/825,313, filed May 20, 2013; and U.S. Provisional Patent Application Ser. No. 61/828,743, filed May 30, 2013.

FIELD OF THE INVENTION

The invention relates to a process for improving the properties of a distillate feedstock having an organic nitrogen concentration, a polyaromatics concentration and a cetane index.

BACKGROUND OF THE INVENTION

Distillate feedstocks that have significant concentrations of organic nitrogen and polyaromatic compounds are more difficult to upgrade by the removal of the nitrogen and polyaromatic compounds in order to provide a saleable product than it is to upgrade distillate feedstocks of which the primary concern is the removal of organic sulfur and monoaromatic compounds.

In recent years, distillate product quality specifications have become more stringent, which have made it more difficult to meet the quality specifications with existing processing schemes. Due to these new, more stringent product specifications, existing processes are required to be modified so as to be able to process the distillate feedstocks to yield products that meet the specifications. Also, it is desirable to develop new processes that can provide for the manufacture of distillate products which meet the more stringent standards. For diesel fuel products, the quality correlates with the Cetane Index. Generally, it is desired to have a high Cetane Index that is preferably greater than 40. The value of the Cetane Index for diesel fuel tends to negatively correlate with the aromatics concentration level with higher concentrations of aromatics tending to lower the Cetane Index and lower concentrations tending to increase the Cetane Index.

In the processing of diesel feedstocks, it typically is more difficult to convert or remove concentrations of polyaromatics than it is to convert or remove comparable concentrations of monoaromatics, and it is also more difficult to convert or remove concentrations of organic nitrogen than it is to convert or remove comparable concentration levels of organic sulfur.

One process for producing a low sulfur diesel product with a high cetane number is disclosed in U.S. Pat. No. 7,790,020. In this process, a diesel feed is first subjected to a hydrodesulfurization step, operated at low-pressure conditions, with a minimal saturation of aromatics. The effluent from the desulfurization zone is then introduced into a separation zone whereby it is separated into a vapor stream and a liquid hydrocarbon stream. The liquid hydrocarbon stream is admixed with hydrogen and the admixture is passed to a substantially liquid-phase continuous reaction zone that is operated at high-pressure conditions significantly above those of the hydrodesulfurization step to provide for the saturation of aromatics and to yield an effluent having an improved cetane number of at least 40. Due to the operation of the hydrotreating zone at a low pressure, a small, low-pressure recycle compressor, instead of a high-pressure recycle compressor, is used to recycle hydrogen to the first stage hydrodesulfurization zone. There is no mention of hydrodenitrogenation or partial saturation of polyaromatics to monoaromatics as taking place in the first step of the process. Due to the low-pressure operation of the first step, it would be expected that no significant hydrodenitrogenation of a feedstock having a high organic nitrogen concentration would occur. It is further noted that there is no mention of the use of multiple catalyst beds contained within a single reactor vessel or the use of interbed quenching.

Another process disclosed in the art for the hydrotreating of middle distillate feeds to produce a low-sulfur and low-aromatic diesel product is described in U.S. Pat. No. 5,110,444. This process employs three reaction zones in series with the first two reaction zones intended to provide a high degree of desulfurization and the third reaction zone intended to provide a high degree of aromatics saturation. The hydrocarbons leaving the first and second reaction zones are subjected to countercurrent stripping with hydrogen to remove hydrogen sulfide prior to passage into the next reaction zone. The first reaction zone employs a desulfurization catalyst that comprises nickel and molybdenum or a cobalt and molybdenum on a support. The second reaction zone provides a mild desulfurization and utilizes a noble metal catalyst. The second reaction zone is maintained at desulfurization conditions similar to those of the first reaction zone, but it is operated at a higher pressure and lower temperature. The third reaction zone is a hydrogenation zone that contains a catalyst comprising a noble metal on an inorganic support. The reaction conditions of the third reaction zone are maintained to provide for the saturation of a substantial portion of the aromatic hydrocarbons present in the entering materials, with a low hydrogen sulfide concentration and at the highest pressure and lowest temperature of the three reaction zones of the process.

U.S. Pat. No. 5,114,562 discloses a process for hydrotreating middle distillate feeds to produce a low-sulfur and low-aromatic product. The process of U.S. Pat. No. 5,114,562 utilizes two reaction zones in series instead of three reaction zones in series as in the process of U.S. Pat. No. 5,110,444. The first reaction zone is intended to provide a high degree of desulfurization, and the second reaction zone is intended to provide a high degree of aromatics saturation. The effluent from the first reaction zone is purged of hydrogen sulfide by countercurrent stripping with hydrogen prior to passage to the second reaction zone. The first reaction zone uses a desulfurization catalyst comprising nickel and molybdenum or cobalt and molybdenum on a support, and the second reaction zone uses a noble metal hydrogenation catalyst that comprises platinum or palladium on alumina.

Although there are a wide variety of process flow schemes, operating conditions and catalysts that are used in the processing of middle distillate feedstocks to make diesel products, there is always a desire to provide new and more economical or better methods of manufacturing diesel products. In many cases, even minor variations in process flows or operating conditions or in the catalyst used can have significant effects on process performance and the quality of the end-products.

SUMMARY OF THE INVENTION

Accordingly, a process is provided for improving the properties of a distillate feedstock having an organic nitrogen concentration, a polyaromatics concentration and a Cetane Index. The process includes contacting the distillate feedstock with a first catalyst contained within a first reaction zone for the hydrodenitrogenation of organic nitrogen compounds and for the saturation of polyaromatic compounds, wherein the first reaction zone is operated under suitable hydrodenitrogenation and polyaromatics saturation conditions, and yielding from the first reaction zone a treated effluent having a reduced organic nitrogen concentration relative to the organic nitrogen concentration and a reduced polyaromatics concentration relative to the polyaromatics concentration. The treated effluent is separated into a heavy fraction and a lighter fraction. The heavy fraction is contacted with a second catalyst contained within a second reaction zone for the saturation of monoaromatics, wherein the second reaction zone is operated under suitable monoaromatics saturation conditions, and yielded from the second reaction zone is a reactor product, wherein the second catalyst comprises a base metal catalyst comprising either a nickel component or cobalt component and either a molybdenum component or a tungsten component supported on an inorganic oxide support, and wherein the reactor product comprises a distillate portion having an enhanced cetane index relative to the cetane index of the distillate feedstock.

BRIEF DESCRIPTION OF THE DRAWING

FIG. 1 is a simplified process flow diagram representing an embodiment of the inventive process for improving the properties of a distillate feedstock to yield a high quality diesel product.

DETAILED DESCRIPTION

As mentioned above, the inventive process deals with the processing of middle distillate feedstocks in order to make low-sulfur diesel that has a low aromatics content. The low aromatics content provides for a diesel product that has a high value for its cetane index. This process is especially useful in the processing of middle distillate feedstocks having high concentrations of organic nitrogen compounds that need to be removed as well as high concentrations of organic sulfur compounds to provide a low-sulfur, and, preferably, an ultra-low sulfur, diesel product. It also is a feature of the process to provide for the processing of such middle distillate feedstocks that also have a concentration of polynuclear aromatic compounds that need to be removed in order to provide a diesel product meeting required quality characteristics as represented by its characteristic Cetane Index.

The prior art processes typically are not focused on the removal of organic nitrogen compounds from a distillate feedstock, but, rather, the focus is on desulfurization. These processes further do not address both denitrogenation and polynuclear aromatics saturation of distillate feedstocks having atypically high concentrations of both organic nitrogen and polynuclear aromatic compounds as well as concentrations of organic sulfur. The inventive process, however, provides for the processing of such difficult-to-treat feedstocks in order to yield a low-sulfur, preferably, an ultra-low sulfur, diesel product that has especially low concentrations of both polynuclear and monoaromatic compounds.

Another feature of the inventive process is that it provides for the processing of the difficult-to-treat feedstocks without the use of highly expensive noble metal catalysts. The process provides for the use of certain low-cost base metal catalysts in the saturation of aromatics.

The feedstocks of the inventive process are selected from middle distillates, such as diesel fuel, jet fuel, kerosene and gas oils. The particular feedstocks that are of the focus of the process are those middle distillate feedstocks that contain significant concentrations of organic nitrogen compounds and polynuclear aromatics that need to be removed in order to provide a final diesel product that meets the required quality standards. These feedstocks typically have a characteristically low Cetane Index due to the presence of significant concentrations of mono or polynuclear aromatics. These feedstocks also typically have significantly high concentrations of organic sulfur, which also must be removed in order to provide the final diesel product having a low enough concentration of sulfur to meet the requirements of a low-sulfur diesel product and, preferably, an ultra-low diesel product.

The middle distillates typically comprise a hydrocarbon fraction boiling in the range of from about 300° F. (149° C.) to about 700° F. (371° C.), as determined by test method ASTM D86. The kerosene boiling range is from about 300° F. (149° C.) to about 450° F. (232° C.), and the diesel boiling range is from about 450° F. (232° C.) to about 700° F. (371° C.). Gasoline normally has a boiling range of from the boiling temperature of amylenes to an endpoint of about 400° F. (204° C.). A gas oil fraction will normally have a boiling range of between about 600° F. (316° C.) to about 780° F. (416° C.). The boiling point ranges of the various product fractions will vary depending on specific market conditions, refinery locations, etc. It is common for boiling ranges to differ or overlap between refineries.

The middle distillate feedstock may include any one or more of a variety of feedstocks such as straight run diesel, jet fuel, kerosene or gas oils, vacuum gas oils, coker distillates, catalytic cracker distillates and hydrocracker distillates. The preferred middle distillate feedstock is one that may be processed by the inventive process so as to provide a final diesel product that meets saleable product specifications, but, especially, a low-sulfur or ultra low-sulfur diesel product that has a high Cetane Index.

It is preferred for the middle distillate feedstock of the process to have an initial boiling point of greater than about 350° F. (177° C.), and, it is also preferred for it to have a 10% point of at least about 370° F. (188° C.). It is preferred for the 90% point of the middle distillate feedstock to be less than about 700° F. (371° C.).

The middle distillate feedstock of the process contains a concentration of nitrogen compounds, most of which are organonitrogen compounds, in an amount in the range of from 100 ppmw to 3500 ppmw. More typically, for the distillate feedstocks that are expected to be handled by the process, the nitrogen concentration of the middle distillate feedstock is in the range of from 200 ppmw to 2500 ppmw, and, most typically, from 250 ppmw to 1000 ppmw.

When referring herein to the nitrogen content of a feedstock, product or other hydrocarbon stream, the presented concentration is the value for the nitrogen content as determined by the test method ASTM D5762-12 entitled "Standard Test Method for Nitrogen in Petroleum and Petroleum Products by Boat-Inlet Chemiluminescence." The units used in this specification, such as ppmw or wt. %, when referring to nitrogen content are the values that correspond to those as reported under ASTM D5762, i.e., in micrograms/gram (μg/g) nitrogen, but converted into referenced unit.

The total sulfur content of the middle distillate feedstock will normally be in the range of from about 0.1 wt. % to about 3.5 wt. %. More typically, however, the sulfur content, which is generally in the form of organic sulfur compounds, is in the range of from 0.15 wt. % to 2.0 wt. %.

When referring herein to "sulfur content" or "total sulfur" or other similar reference to the amount of sulfur that is contained in a feedstock, product or other hydrocarbon stream, what is meant is the value for total sulfur as determined by the test method ASTM D2622-10, entitled "Standard Test Method for Sulfur in Petroleum Products by Wavelength Dispersive X-ray Fluorescence Spectrometry." The use of weight percent (wt. %) values of this specification when referring to sulfur content correspond to mass % values as would be reported under the ASTM D2622-10 test method.

One of the particular problems that the inventive process seeks to address is the processing of middle distillate feedstocks that have significant concentrations of polyaromatic, or polynuclear aromatic, hydrocarbons in order to provide a diesel product that has a significantly low aromatics content such that its Cetane Index is acceptably high. Not all feedstocks will contain significant concentrations of polyaromatic compounds. Polyaromatics are known to be particularly potent atmospheric pollutants and their presence in diesel fuel tend to lower its Cetane Index.

Polyaromatic compounds in general consist of fused aromatic rings and normally do not contain heteroatoms or have substituents. The simplest of the polyaromatics is naphthalene, which contains only two aromatic rings. Other simple polyaromatic compounds include, for example, anthracene (3 rings), tetracene (4 rings), and pentacene (5 rings). The polyaromatic molecules of the middle distillate feedstock of the process predominantly comprise two and three aromatic rings with very little, if any, four ring compounds. The aromatic rings of the polyaromatic compounds may be arranged in any order and relative to each other by no particular geometric arrangement.

The concentration of the polyaromatics in the middle distillate feedstock of the invention typically will be at least about 12 wt. % of the feedstock. One of the features of the inventive process is that is provides for the processing of middle distillate feedstocks that have significantly high concentrations of polyaromatic compounds, and, thus, the amount of polyaromatics contained in feedstock of the process can exceed 15 wt. %, and it even can be greater than 17 wt. %. The upper end of the range for the polyaromatics concentration of the middle distillate feedstock can be less than 50 wt. % or less than 30 wt. %, or even less than 15 wt. %. A typical range for the polyaromatics concentration can be from 12 wt. % to 50 wt. %, or from 15 wt. % to 30 wt. % or to 25 wt. %.

Regarding the monoaromatic compounds, e.g. benzene and benzene derivatives, such as the alkyaromatic compounds of toluene, xylene, ethylbenzene and the like, the concentration thereof in the middle distillate feedstock is at most 40 wt. %. Typically, the concentration of monoaromatic compounds in the middle distillate feedstock is greater than 1 wt. % and less than 25 wt. %, and, more typically, it is in the range of from 2 wt. % to 15 wt. %.

The method used to determine the hydrocarbon type (i.e., saturates, monoaromatics, diaromatics, and polyaromatics) and to measure the amounts of monoaromatic hydrocarbons, diaromatic hydrocarbons, triaraomtic hydrocarbons in a feedstock, product or other hydrocarbon stream is the IP391 Method, which uses high performance liquid chromatography (HPLC) with refractive index detection.

The term "Cetane Index" that is used in this specification is a calculated number based on the density of the diesel fuel and its distillation range as determined by test method ASTM D86. The term "Cetane Index," therefore, as it is used herein, means the calculated number as it is determined by the test method ASTM D4737, entitled "Calculated Cetane Index by Four Variable Equation." This four point method is based on the density of the diesel fuel and the 10%, 50%, and 90% recovery temperatures of a distillation of the diesel fuel as determined by the test method ASTM D86.

The middle distillate feedstock of the process will, generally, have a low Cetane Index that makes it unsuitable as a diesel product even if the feedstock were to otherwise meet certain of the other product specifications such as the sulfur content and nitrogen content. The Cetane Index of the middle distillate feedstock, thus, is less than about 40. More typically, however, its Cetane Index is less than 35, and, even, less than 30.

One of the beneficial aspects of the inventive process is that it provides for the processing of the middle distillate feedstock to yield a final diesel product having a suitably high Cetane Index. It is preferred for the Cetane Index of the final diesel product to be at least 40. Usually, the process can provide a diesel product having a Cetane Index in the range of from about 40 to about 50. It is most preferred for the Cetane Index to be as high as is feasible and, thus, greater than 45 or even greater than 49. A practical upper limit for the range of values for Cetane Index of the final diesel product provided by the process is less than 65 or even less than 60.

The term "Cetane Index" that is used in this specification is a calculated number based on the density of the diesel fuel and its distillation range as determined by test method ASTM D86. The term "Cetane Index," therefore, as it is used herein, means the calculated number as it is determined by the test method ASTM D4737, entitled "Calculated Cetane Index by Four Variable Equation." This four point method is based on the density of the diesel fuel and the 10%, 50%, and 90% recovery temperatures of a distillation of the diesel fuel as determined by the test method ASTM D86.

The process of the invention includes two reaction zones. The first reaction zone, which is defined by a first reactor vessel, is operated under suitable hydrodenitrogenation and polyaromatics saturation conditions so as to provide for the hydrodenitrogenation of the organic nitrogen and for the saturation of the polyaromatics that are contained in the middle distillate feedstock to at least monoaromatic compounds. A treated effluent is yielded from the first reaction zone. The treated effluent has an organic nitrogen concentration and a polyaromatics concentration that are reduced below such concentrations of the distillate feedstock charged to the first reaction zone.

The second reaction zone, which is defined by a second reactor vessel, is operated under suitable monoaromatics saturation conditions so as to provide for the saturation removal of at least a portion of the monoaromatics that are contained in a heavy fraction feed charged to the second reaction zone. The heavy fraction feed is supplied from a first separator that is interposed between the first reaction zone and the second reaction zone. The first separator defines a first separation zone, which receives the treated effluent from the first reaction zone. The first separator provides for separating the treated effluent into a heavy fraction and a lighter fraction. The heavy fraction passes from the first separation zone as a feed to the second reaction zone.

A reactor product, which comprises a distillate portion, is yielded from the second reaction zone. This reaction product has a monoaromatics concentration that is reduced relative to the monoaromatics concentration of the heavy fraction feed to the second reaction zone due to the saturation of at least a portion of the monoaromatics contained in the heavy fraction. This reduction in the concentration amount of aromatics in the heavy fraction feed correlates with an improvement or enhancement in the Cetane Index of the distillate portion of the heavy fraction over the Cetane Index of the distillate feedstock to the process.

Hydrogen is usually required to be added to the process due to the hydrodenitrogenation, hydrodesulfurization and aromatics saturation that are provided by the process. Thus, make-up hydrogen is introduced into the process. The introduction of the make-up hydrogen into the process may be at any one of a number of suitable locations. Make-up hydrogen can be introduced with the distillate feedstock, or it can be introduced into the suction side of a hydrogen recycle compressor (later described), or it can be introduced into the heavy fraction, or it can be introduced at any number of other suitable locations within the process. In one desirable embodiment of the inventive process, a make-up hydrogen feed, which comprises hydrogen, is introduced into the heavy fraction prior to introducing the resulting mixture, comprising the make-up hydrogen and the heavy fraction, into the second reaction zone.

The hydrogen and lighter hydrocarbons need to be separated from reactor product of the second reaction zone in order to provide a final diesel product that meets the required product specifications. The reactor product then passes from the second reaction zone to a second separator. The second separator defines a second separation zone, which receives the reactor product and provides for the separation thereof into a first hydrogen portion and a dearomatized distillate portion. The first hydrogen portion comprises hydrogen, and, may also include light, normally gaseous, under the conditions of the second separation zone, hydrocarbons.

The dearomatized distillate portion is passed to a product stripper. The product stripper defines a stripping zone and provides for removing lighter hydrocarbons, hydrogen sulfide and ammonia from the dearomatized distillate portion. Yielded from the product stripper is a diesel product and an overhead product, which comprises lighter hydrocarbons, hydrogen sulfide and ammonia. Thus, yielded as a bottoms product from the product stripper is a diesel product that has a characteristically high Cetane Index. The diesel product also has significantly reduced polyaromatics and monoaromatics concentration levels as compared to the distillate feedstock to the process. Also, the diesel product has a significantly reduce concentrations of organic nitrogen and organic sulfur. The yielded diesel product, thus, is of a very high quality as being able to meet specifications for a low-sulfur diesel product having a high Cetane Index.

The diesel product provided by the process is a low-sulfur diesel having a sulfur concentration that is, typically, less than 50 ppmw, but it is more desirable for the sulfur concentration of the diesel product to less than 25 ppmw. Preferably, the diesel product sulfur concentration is less than 15 ppmw, and, most preferably, it is less than 10 ppmw.

The Cetane Index of the diesel product is typically at least or greater than 40, but, preferably, it is at least or greater than 42. Especially preferred is for the Cetane Index of the diesel product to be at least or greater than 45. The diesel product from the process may be blended with other diesel components that have lower values, or higher values, for their Cetane Index in order to provide a blended product that meets certain specified Cetane Index requirements.

As discussed elsewhere herein, a particularly beneficial feature of the inventive process is that it provides for a final diesel product having a low total nitrogen concentration. Typically, the process provides a diesel product having a concentration of organic nitrogen that is less than 100 ppmw. It is preferred, however, for the nitrogen concentration to be less than 50 ppmw, and, more preferred, for the nitrogen concentration to be less than 30 ppmw. An especially preferred nitrogen concentration is less than 25 ppmw. The lower limit for the nitrogen concentration is typically not measurable.

Another of the particularly beneficial features of the inventive process is that it provides for the removal of the polyaromatics and monoaromatics from the middle distillate feedstock to provide the diesel product having a substantially reduced aromatics content over that of the middle distillate feedstock to the process. This is predominantly done by the hydrogen saturation in the first reaction zone and the second reaction zone of the process. The total aromatics content of the diesel product of the process, thus, is less than 40 wt. %.

The concentration of polyaromatics in the diesel product is less than 11 wt. % with the remainder being monoaromatics. It is preferred for the concentration of polyaromatics in the diesel product to be less than 8 wt. %, and, more preferred, the concentration of polyaromatics is less than 2 wt. %.

The amount of monoaromatics contained in the diesel product typically can be in the range of from about 0.5 wt. % to about 30 wt. %. More typically, the concentration of monoaromatics is in the range of 5 wt. % to 25 wt. %. Most typically, the concentration is from 10 wt. % to 20 wt. %.

The lighter fraction from the first separator passes to a third separator. The third separator defines a third separation zone and provides for the separation of the lighter fraction into a second hydrogen portion and a liquid hydrocarbon portion. The liquid hydrocarbon portion is normally in the liquid phase under the typical operating conditions of the third separator zone. The liquid hydrocarbon portion may then be passed and introduced as a feed to the product stripper and the second hydrogen portion may be recycled and combined with the middle distillate feedstock to be fed to the first reaction zone.

In an embodiment of the process, the second hydrogen portion may be treated to remove therefrom hydrogen sulfide and ammonia before the resulting treated second hydrogen portion is recycled, preferably, by way of a recycle compressor, as a feed to the first reactor vessel. In this feature of the process, the second hydrogen portion is introduced into a contactor vessel. The contactor vessel defines a contacting zone and provides for contacting the second hydrogen portion with an absorption solvent, which functions to remove hydrogen sulfide and ammonia from the second hydrogen portion. The absorption solvent is countercurrently and stagewise contacted with the second hydrogen portion under suitable absorption contacting conditions. The absorption solvent can be any suitable solvent known to those skilled in the art for use as aforementioned. There are many known amine compounds that are in use for such applications.

The treated hydrogen portion then passes from the contacting zone to the suction side of a recycle compressor. The recycle compressor provides for compressing and recycling of the treated hydrogen portion to the first reactor zone. The resulting compressed and treated second hydrogen portion then passes from the discharge side of the recycle compressor and is introduced as a feed into the first reaction zone of the process along with the introduction of the middle distillate feedstock.

The first hydrogen portion may also be recycled as a feed to the first reaction zone. The first hydrogen portion passes from the second separation zone of the second separator either directly to the first reaction zone without prior compression, or it may be introduced to the suction side of the recycle compressor along with the treated first hydrogen portion to be compressed and passed to the first reaction zone with the middle distillate feedstock.

It is a unique aspect of the inventive process that both the first reaction zone and the second reaction zone are operated under high pressure reaction conditions. Certain of the prior art processes that provide for aromatics saturation such as the one disclosed in U.S. Pat. No. 7,790,020 utilize multiple reaction zones wherein the first reaction step is operated under low-pressure conditions and the second reaction step is operated under high-pressure conditions. The low-pressure reaction conditions typically do not provide for significant aromatics or organic nitrogen saturation.

In the inventive process, the second reaction zone operates at only a slightly higher reaction pressure than does the first reaction zone. One reason for operating the second reaction zone at a higher pressure than the first reaction zone is so as to provide a driving force to recycle the first hydrogen portion from the second separation zone to the first reaction zone without need or use of a recycle compressor, although, the use of a recycle compressor for recycling the first hydrogen portion to the first reaction zone is also an option. This may be done with a separate recycle compressor or by introducing the first hydrogen portion with the second hydrogen portion into the suction side of a single compressor either at the same compressor stage or at different stages of the recycle compressor.

It is an advantage of the process, however, that the slightly higher operating pressure of the first reaction zone over the operating pressure of the second reaction zone eliminates the need for either a separate recycle compressor or a larger single recycle compressor due to the higher volume of recycle gas contributed by the combination of the first hydrogen portion and the second hydrogen portion streams. Typically, the second reaction zone reaction pressure is in the range of from 10 to 100 psig greater than the first reaction zone pressure. Preferably, the second reaction zone reaction pressure is in the range of from 20 to 80 psig greater than the first reaction zone pressure, and, most preferably, it is from 25 to 75 psig.

The first reactor is operated as a trickle-flow reactor in that the middle distillate feed that is charged to the first reaction zone is generally in liquid form, admixed with either make-up hydrogen or recycle hydrogen or a combination of both, and charged to the first reaction zone in a downflow direction. The reaction conditions within the first reaction zone are such as to be effective to provide for significant hydrodenitrogenation of the organic nitrogen compounds of the middle distillate feedstock and for significant hydrogen saturation of polyaromatics in order to yield a treated effluent from the first reaction zone that has a reduced organic nitrogen concentration relative to the organic nitrogen concentration of the middle distillate feedstock and a reduced polyaromatics concentration relative to the polyaromatics concentration of the middle distillate feedstock.

The first reaction zone will, thus, be operated at a first reaction zone temperature in the range of from 400° F. to 800° F., preferably, from 450° F. to 750° F., and, most preferably, from 500° F. to 700° F.

The pressure at which the first reaction zone is operated is an important aspect of the inventive process in that it is a large contributor, in addition to the particular type of catalyst that is used in the first reaction zone, to providing for the hydrogen saturation of the organic nitrogen and polyaromatic compounds of the middle distillate feedstock of the process. A high first reaction zone operating pressure is a necessary operating condition of the inventive process.

The first reaction zone pressure of the process will typically be in the range of from 1000 to 2000 psig, but, preferably, it is in the range of from 1000 to 1500 psig. More preferably, the first reaction zone pressure is in the range of from 1050 psig to 1300 psig.

The liquid hourly space velocity (LHSV) at which the first reaction zone is operated is typically in the range of from 0.1 $hr^{-1}$ to 100 $hr^{-1}$. Preferably, the LHSV is in the range of from 0.5 $hr^{-1}$ to 10 $hr^{-1}$.

The catalyst that is used in the first reaction zone, referred to herein as the first catalyst, should be any catalyst composition that suitably provides for the hydrodenitrogenation and polyaromatics saturation required of the process.

Generally, the first catalyst is a base metal catalyst in that it comprises a Group VIII metal that is either cobalt of nickel, or a combination of both, or a Group VI metal that is either molybdenum or tungsten, or a combination of both, or a combination of either the Group VIII metal and the Group VI metal, supported on a high surface area material that is preferably an inorganic oxide such as silica, alumina, silica-alumina, or a combination thereof.

The Group VIII metal is typically present in the base metal catalyst in an amount in the range of from about 2 to about 20 weight percent, preferably from about 4 to 12 about weight percent.

The Group VI metal is typically present in the base metal catalyst in an amount in the range of from about 1 to about 25 weight percent, preferably from about 2 to 25 weight percent.

Particularly preferred catalyst compositions for use as the first catalyst are those that are disclosed or claimed in U.S. Pat. No. 8,262,905, issued Sep. 11, 2012, which patent is incorporated herein by reference. This catalyst is preferred because of its beneficial properties over other base metal catalyst compositions and because of how it helps to provide for the hydrodenitrogenation and polyaromatics saturation that are required of the first reaction step of the inventive process. This catalyst, in general, comprises a support material that is loaded with a base metal component, which is or can be converted to a metal compound having hydrogenation activity, and is impregnated with a polar additive with or without an accompanying hydrocarbon oil. The catalyst also may be a derivative of the aforedescribed catalyst, such as, the impregnated catalyst that has undergone a hydrogen and sulfur treatment. Suitable and exemplary catalysts are described in detail in the aforementioned U.S. Pat. No. 8,262,905. The metal loadings are within the ranges described above.

Another preferred catalyst composition for use as the first catalyst of the first reaction zone include those that are disclosed or claimed in U.S. Pat. No. 6,218,333, issued Apr. 17, 2001, or U.S. Pat. No. 6,281,158, issued Aug. 28, 2001, or U.S. Pat. No. 6,290,841, issued Sep. 18, 2001. These patents are incorporated herein by reference. This catalyst provides for many of the same benefits as does the catalyst of U.S. Pat. No. 8,262,905. This catalyst, in general, comprises a composition that is prepared by combining a porous support with a base metal and reducing the volatiles content of the combination mixture to form a precursor that is not calcined before sulfurizing the combination mixture after the volatiles reduction. The metal loadings are within the ranges described above.

In one particular embodiment of the inventive process, the first reaction zone that is defined by the first reactor includes at least two distinct or two or more catalyst beds. Within each catalyst bed is a bed of catalyst particles of a first catalyst that are supported upon a support internal that spans the cross-sectional area of the first reactor and provides support for each of the beds of catalyst particles having a bed depth. The multiple catalyst beds contained in the first reaction zone are placed in a spaced relationship to each other so as to form a void volume space between each bed within the first reaction zone. The formation of the void volume spaces between the catalyst beds allows for the introduction of quench gas into each of the volume spaces and for better control of the temperature conditions within the first reaction zone. This control of the temperature conditions also allows for better control of the reaction conditions within the first reaction zone so as to control the conditions for the polyaromatics saturation and organic nitrogen hydrogenation.

In another aspect of the inventive process, the second reaction zone, in addition to operating under high reactor pressure conditions, utilizes a catalyst that is not a noble metal catalyst as used in many of the prior art processes. Instead, the catalyst used in the second reaction zone is a base metal catalyst. Therefore, the second catalyst contained within the second reaction zone that is to be used in the second reaction zone comprises a Group VIII metal that is either cobalt of nickel, or a combination of both, or a Group VI metal that is either molybdenum or tungsten, or a combination of both, or a combination of either the Group VIII metal and the Group VI metal, supported on a high surface area material that is preferably an inorganic oxide such as silica, alumina, silica-alumina, or a combination thereof. The metal loadings are within the same ranges as described above for the first catalyst.

It is also noted that preferred catalyst compositions for use as the second catalyst of the process include the catalyst compositions disclosed or claimed in U.S. Pat. Nos. 8,262,905, or 6,218,333, or 6,281,158, or 6,290,841, and as described above for the first catalyst.

The second reaction zone of the process is operated so as to provide for the saturation of the monaromatic compounds that are contained in the heavy fraction from the first separation zone. The heavy fraction is therefore contacted with the second catalyst of the second reaction zone which is operated under suitable conditions for the saturation of the monoaromatics of the heavy fraction and to yield the second reaction zone reactor product.

The pressure and temperature at which the second reaction zone is operated are such as to provide for the hydrogen saturation monaromatic compounds of the heavy fraction of the process. A high second reaction zone operating pressure is a necessary operating condition of the inventive process. The second reaction zone pressure of the process will typically be in the range of from 1000 to 2000 psig, but, preferably, it is in the range of from 1000 to 1500 psig. More preferably, the second reaction zone pressure is in the range of from 1050 psig to 1300 psig.

The operating pressure of the second reaction zone, however, as discussed above, is in the range of from 10 to 100 psig greater than the first reaction zone pressure, or from 20 to 80 psig greater than the first reaction zone pressure, or from 25 to 75 psig greater than the first reaction zone pressure.

The second reaction zone is operated at a second reaction zone temperature in the range of from 400° F. to 800° F., preferably, from 450° F. to 750° F., and, most preferably, from 500° F. to 700° F. The liquid hourly space velocity (LHSV) at which the second reaction zone is operated typically in the range of from 0.1 $hr^{-1}$ to 100 $hr^{-1}$. Preferably, the LHSV is in the range of from 0.5 $hr^{-1}$ to 10 $hr^{-1}$.

Presented in FIG. 1 is a representative flow scheme of an embodiment of the inventive process 10. Process 10 provides for improving the properties of a distillate feedstock having significant concentrations of nitrogen and polyaromatic compounds.

A middle distillate feedstock is introduced into first reactor 14 by way of conduit 12. Before the middle distillate feedstock is introduced into first reactor 14, it is combined with a recycle hydrogen stream that passes to first reactor 14 by way of conduit 16.

First reactor 14 defines first reaction zone 18. First reactor 14, which defines the first reaction zone 18, includes at least two distinct catalyst beds 20. Within each of the catalyst beds 20 is a bed of catalyst particles supported upon a support internal 22 that spans the cross-sectional area of the first reactor 14 and provides support for each of the beds of catalyst particles having a bed depth. The catalyst particles of the catalyst beds 20 include a first catalyst as described herein.

The catalyst beds 20 are in a spaced relationship to each other so as to thereby provide void volumes 24 between each of the at least two distinct catalyst beds 20. A quench fluid is introduced into each of the void volumes 24 by way of conduit 28 to provide for interbed quenching and temperature control.

The combined distillate feedstock and recycle hydrogen passes by way of conduit 32 and is introduced into first reaction zone 18 wherein it is contacted with the first catalyst contained in the catalyst beds 20 of the first reaction zone 18. The first reaction zone 18, which includes the catalyst beds 20, is operated under hydrodenitrogenation and polyaromatics saturation conditions as described elsewhere herein.

A treated effluent is yielded and passes from the first reaction zone 18 by way of conduit 34 to be introduced into first separator 38. The treated effluent has a significantly reduced organic nitrogen and polyaromatics concentrations relative to such concentrations of the middle distillate feedstock.

First separator 38 defines a first separation zone 40, and it provides for the separation of the treated effluent into a heavy fraction and a lighter fraction. The first separator 38 operates as a hot, high-pressure separator in that the treated effluent from first reaction zone 18 that is introduced into the first separation zone 40 is not significantly cooled before its introduction and the operating pressure of the first separation zone 40 is maintained only slightly below the operating pressure of first reaction zone 18. The pressure differential between first separation zone 40 and first reaction zone 18 is such as to provide a driving force for the flow of the treated effluent into first separation 40 and to allow for its effective control.

The heavy fraction passes from first separation zone 40 through conduit 42 to second reactor 44. Second reactor 44 defines a second reaction zone 46 that includes or contains a bed of second catalyst. The second catalyst is described in detail elsewhere herein. The second reaction zone 46 is operated under monoaromatics saturation conditions as described elsewhere herein.

Make-up hydrogen passing by way of conduit 48 is combined with the heavy fraction before the resulting mixture of make-up hydrogen and heavy fraction is introduced into the second reaction zone 46. The heavy fraction is contacted with the second catalyst contained within second reaction zone 46.

A reactor product is yielded and passes from second reaction zone 46 through conduit 50 to second separator 54. The reactor product comprises a distillate portion having a value for its Cetane Index that is much enhanced over the Cetane Index of the middle distillate feedstock charged to the process 10.

The reactor product is introduced into the second separator 54 which defines a second separation zone 56 and provides for the separation of the reactor product into a first hydrogen portion and a dearomatized distillate portion.

The dearomatized distillate portion passes from second separation zone 56 by way of conduit 60 and is introduced into stripping zone 64 that is defined by product stripper 62. The product stripper 62 provides means for stripping or removing lighter hydrocarbons from the dearomatized distillate portion charged to the product stripper 62 and it provides for yielding a diesel product. The yielded diesel product, having the properties as specified herein, passes from stripping zone 64 through conduit 66, and the lighter hydrocarbons that are stripped from the dearomatized distillate portion pass from stripping zone 64 by way of conduit 68.

The lighter fraction that is yielded from first separation zone 40 passes from first separation zone 40 by way of conduit 70 and is introduced into third separation zone 72. Third separation zone 72 is defined by third separator 74. Third separator 74 provides for the separation of the lighter fraction from the first separation zone 40 into a second hydrogen portion and a liquid hydrocarbon portion. The liquid hydrocarbon portion passes from third separation zone 72 by way of conduit 78 and is introduced as a feed into stripping zone 64 of product stripper 62.

The second hydrogen portion passes from third separation zone 72 through conduit 80 and is introduced into contacting zone 82 that is defined by contactor 84. Contactor 84 provides for contacting the second hydrogen portion with an absorption solvent, such as, any suitable solvent known to those skilled in the art of gas treating, including amine solvents, for the absorption removal of hydrogen sulfide or ammonia from the second hydrogen portion.

The contacting of the second hydrogen portion with absorption is typically done in a stage-wise manner and counter currently. Various contacting means such as contacting trays or packing may be operably installed within separation zone 82 that provides for the counter-current contacting of the second hydrogen portion with the absorption solvent. A lean absorption solvent is introduced into contacting zone 82 through conduit 86 and a rich absorption solvent is removed from contacting zone 82 through conduit 88.

The treated hydrogen portion passes from contacting zone 82 by way of conduit 90 to the suction side of recycle compressor 94. Recycle compressor 94 defines a compression zone 96 and provides for the compression and recycling of the treated hydrogen portion to first reactor zone 18. The compressed treated hydrogen portion passes from recycle compressor 94 through conduits 98 and 16.

The first hydrogen portion that is yielded from second separation zone 56 passes through conduits 100 and 16 to be introduced into first reaction zone 18 along with the compressed treated hydrogen portion from the discharge side of recycle compressor 94 and middle distillate feedstock thorough conduit 12. In optional embodiments the first hydrogen portion may be passed as a feed to contacting zone 82 (conduit not shown) or it may be introduced into the suction side or one of the stages of recycle compressor 94 (conduit not shown).

It will be apparent to one of ordinary skill in the art that many changes and modifications may be made to the invention without departing from its spirit and scope as set forth herein.

The invention claimed is:

1. A process for improving the properties of a distillate feedstock having an organic nitrogen concentration, a polyaromatics concentration and a cetane index, wherein said process comprises:

contacting said distillate feedstock with a first catalyst contained within a first reaction zone for the hydrodenitrogenation of organic nitrogen compounds and for the saturation of polyaromatic compounds, wherein said first reaction zone is operated under suitable hydrodenitrogenation and polyaromatics saturation conditions, including a first reaction zone reaction pressure in the range of from above 4.8 MPa (700 psig) to about 13.8 MPa (2000 psig) and a first reaction zone reaction temperature in the range of from 260° C. (500° F.) to 430° C. (806° F.), wherein said first reaction zone is defined by a first reactor vessel, wherein within said first reaction zone is included at least two distinct catalyst beds, wherein each of said at least two distinct catalyst beds each comprising a bed of catalyst particles supported upon a support internal that spans the cross-sectional area of said first reactor vessel and provides for the support of each of said bed of catalyst particles and each of said bed of catalyst particles has a bed depth, and wherein said catalyst particles include said first catalyst, which is of the type that comprises a Group VIII metal or a Group VI metal, or a combination of both, on an inorganic oxide support, wherein each of said at least two distinct catalyst beds is placed within said first reaction zone in a spaced relationship to each other so as to thereby provide a void volume between each of said at least two distinct catalyst beds within said first reaction zone wherein a quench fluid may be introduced for interbed quenching and temperature control; and yielding from said first reaction zone a treated effluent having a reduced organic nitrogen concentration relative to said organic nitrogen concentration and a reduced polyaromatics concentration relative to said polyaromatics concentration;

separating said treated effluent into a heavy fraction and a lighter fraction; and contacting said heavy fraction with a second catalyst contained within a second reaction zone for the saturation of monoaromatics, wherein said second reaction zone is operated under suitable monoaromatics saturation conditions, including a second reaction zone reaction pressure in the range of from above 4.1MPa (600 psig) to about 13.1MPa (1900 psig), which is in the range of from 10 to 100 psig greater than said first reaction zone reaction pressure, and a second reaction zone reaction temperature in the range of from 204° C. (400° F.) to 430° C. (806° F.);

yielding from said second reaction zone a reactor product, wherein said second catalyst comprises a base metal catalyst comprising either a nickel component or cobalt component and either a molybdenum component or a tungsten component supported on an inorganic oxide support, and wherein said reactor product comprises a distillate portion having an enhanced Cetane Index relative to said cetane index of said distillate feedstock;

combining make-up hydrogen into said heavy fraction to provide a resulting mixture, comprising said make-up hydrogen and said heavy fraction, and introducing said resulting mixture into said second reaction zone;

passing said reactor product to a second separator for separating said reactor product into a first hydrogen portion and a dearomatized distillate portion; and passing said dearomatized distillate portion to a product stripper for removing lighter hydrocarbons from said dearomatized distillate portion and providing a diesel product having a high Cetane Index.

2. A process as recited in claim 1, further comprising:

passing said lighter fraction to a third separator for separating said lighter fraction into a second hydrogen portion and a liquid hydrocarbon portion.

3. A process as recited in claim 2, further comprising:

passing said second hydrogen portion to a recycle compressor for compressing said second hydrogen portion and introducing said second hydrogen portion with said distillate feedstock to said first reaction zone.

4. A process as recited in claim 3, further comprising:

introducing said first hydrogen portion with said distillate feedstock to said first reaction zone.

5. A process as recited in claim 4, further wherein said second reaction zone is defined by a second reactor vessel that includes said second catalyst which provides for the hydrogen saturation of monaromatics and polyaromatics contained in said heavy fraction whereby said enhanced cetane index is obtained.

* * * * *